US005281976A

United States Patent [19]

Imai et al.

[11] Patent Number: 5,281,976

[45] Date of Patent: Jan. 25, 1994

[54] THERMAL TRANSFER PRINTING METHOD

[75] Inventors: Akihiro Imai, Ikoma; Yasuo Fukui, Kadoma; Nobuyoshi Taguchi, Ikoma, all of Japan

[73] Assignee: Matsushita Electric Industrial Co., Ltd., Osaka, Japan

[21] Appl. No.: 744,374

[22] Filed: Aug. 13, 1991

[30] Foreign Application Priority Data

| | | | |
|---|---|---|---|
| Aug. 13, 1990 | [JP] | Japan | 2-214522 |
| Nov. 6, 1990 | [JP] | Japan | 2-302029 |
| Nov. 29, 1990 | [JP] | Japan | 2-333890 |

[51] Int. Cl.[5] ..... B41J 2/325

[52] U.S. Cl. ..... 346/76 PH

[58] Field of Search ..... 346/76 PH; 400/120

[56] References Cited

U.S. PATENT DOCUMENTS

| | | | |
|---|---|---|---|
| 4,580,142 | 4/1986 | Matsushita et al. | 346/76 PH |
| 4,740,798 | 4/1988 | Shinoazaki | 346/76 PH |
| 4,844,770 | 7/1989 | Shiraishi et al. | 400/120 |

FOREIGN PATENT DOCUMENTS 0063892 3/1990 Japan .

*Primary Examiner*—Benjamin R. Fuller

*Assistant Examiner*—N. Le

*Attorney, Agent, or Firm*—Wenderoth, Lind & Ponack

[57] ABSTRACT

The present invention provides a thermal printing method using a sublimable dye, which is capable of faithfully printing on any kind of substrates, including plain paper without the tack sheets which make the process complicated. The method of the present invention comprises forming an image into a printing layer by heating a color layer with a printing head and then transferring the printing layer onto an image receive sheet by pressure or heat; wherein the color layer and printing layer are respectively formed on one substrate in a certain interval of distance without putting one upon another, the surface of the color layer is placed on the surface of the printing layer and heat is applied to the color layer from the substrate side with a printing head to form an image into a printing layer.

The present invention also provide a color ink film comprising a substrate and both a color layer and a printing layer respectively formed on the substrate in a certain interval of distance without putting one upon another, wherein the color layer or the printing layer is formed from polyvinyl butyral having a butyralization degree of not less than 50 mol %.

18 Claims, 10 Drawing Sheets

THERMAL TRANSFER PRINTING METHOD

FIELD OF THE INVENTION

The present invention relates to a novel thermal transfer printing method using a thermal head, a light head (e.g. a laser head) and an electrode head, and a color ink film therefor. More particularly, it relates to a thermal transfer printing method and a color ink film, which make it possible to print on any substrate, typically plain paper, using a sublimable dye.

BACKGROUND OF THE INVENTION

Thermal transfer printing using a sublimable dye is a method wherein a thermal ink film is heaped on an image receive sheet having a printing layer and heated by a thermal head to print images directly onto the printing layer on the image receive sheet. This method is required to use the image receive sheet on which the printing layer is formed and it is impossible to directly print on any substrate.

In order to print on any substrate, such as plain paper, by using a sublimable dye, it is proposed to use a so-called tack sheet which is composed of a substrate, a releasing layer on the substrate, an adhesive layer on the releasing layer and a printing layer on the adhesive layer. Firstly, printing is conducted on the printing layer on the tack sheet from the color ink film and then the printing layer is peeled by hand from the releasing layer and adhered on any substrates through the adhesive layer. Another method using a color ink film on which both a color ink layer and a printing layer are present is also proposed. In this method, the printing layer is transferred onto a plain paper and then the color ink layer is heaped on the printing layer, followed by printing thereon (see Japanese Kokai Publication 2-63892). It, however, is difficult for to conduct the tack sheet method mechanically, because of its tackiness. Also, the tack sheet is essentially used and this makes the process complicated and increases costs. The latter method reduces dot reproducibility because of unevenness of plain paper and ununiformity of cellulose fibers.

SUMMARY OF THE INVENTION

The present invention provides a thermal printing method using a sublimable dye, which is capable of faithfully printing on any kind of substrates, including plain paper, without the tack sheets which make the process complicated. The method of the present invention comprises transferring a color image from a color layer to a printing layer by heating the color layer and then transferring the printing layer onto an image receive sheet by pressure or heat; an improvement residing in that the color layer and printing layer are respectively formed on one substrate in a certain interval of distance without putting one upon another to form a color ink film, the surface of the color layer is placed on the surface of the printing layer and heat is applied to the color layer from the substrate side with a thermal head to transfer the color image.

The present invention also provide a color ink film comprising a substrate, and both a color layer and a printing layer respectively formed on the substrate in a certain interval of distance without putting one upon another, wherein the color layer or the printing layer is formed from polyvinyl butyral having a butyralization degree of not less than 50 mol %.

DETAILED DESCRIPTION OF THE INVENTION

The first embodiment of the thermal transfer printing process of the present invention is a method wherein the color layer and printing layer are respectively formed on one substrate in a certain interval of distance without putting one upon another, the surface of the color layer is placed on the surface of the printing layer and heat is applied to the color layer from the substrate side with a thermal head to transfer the color image.

Figure 1:
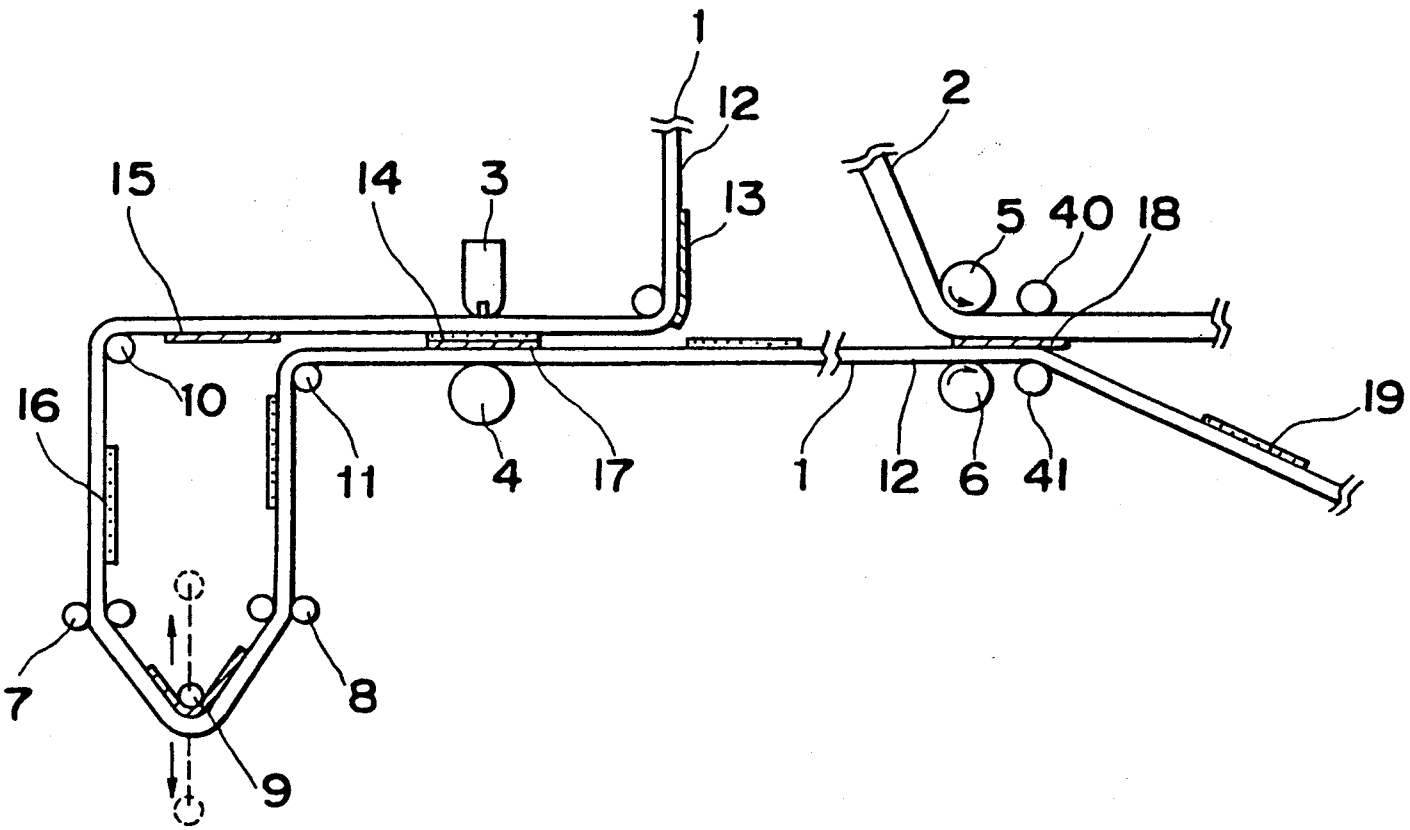
FIG. 1 is a drawing which schematically shows one embodiment of the printing method of the present invention.

The first embodiment is explained by referring to FIG. 1. In FIG. 1, a color ink film 1 has color layers 14, 16 and printing layers 13, 15 which are alternately present on a substrate 12. An image formation onto the printing layer 17 is carried out by placing a color layer (e.g. 14) on the printing layer. Since the color layer 14 and the printing layer 17 are present on the same side of the substrate 12, the color ink film 1 is bent in the side of the layers 14 and 17 to place the color layer 14 on the printing layer 17. In FIG. 1, the color ink film 1 is bent through a roller 10, speed control rollers 7 and 8, an up-down movable roller 9 and a roller 11 and sandwiched between a printing head 3 and a platen roller 4 as facing the color layer 14 with the printing layer 17. Thus, the color ink film 1 is bent and sandwiched in a certain pressure between the printing head 3 and the platen roller 4 and the dyestuff in the color layer 14 is sublimated or diffused into the printing layer 17 to form an image on the printing layer 17. Although the printing head 3 is present on the substrate side of the color layer 14 in FIG. 1, it may be present at the substrate side of the printing layer 17 as required. The speed control rollers 7 and 8 are equipped for controlling a running speed and a position of the color ink film 1. The up-down movable roller 9 is for controlling a tension of the color ink film 1. It is noted that a driving direction of the color ink film is not limited. For example, between the printing head 3 and the platen roller 4, the color layer 14 and the printing layer 17 may drive in the same direction or opposite direction, or may drive at different speeds. In case where the color layer is divided into three layers, for example cyan, magenta and yellow, the system is constituted such that only the color layers may be moved on the same printing layer in an order of for example cyan, magenta and yellow. Also, if necessary, three printing heads may be equipped for three colors to achieve speed-up. The printing head is not limited as long as the color dye in the color layer is sublimated or diffused onto the printing layer. Examples of the printing heads are a thermal head, an electrode head, a light head and the like. In this system, since the printing is carried out between the printing head 3 and the platen roller 4, it is preferred that all the driving systems and the rollers are constituted as just placing the color layers on the printing layers.

Subsequently, the color ink film 1 with the image-formed printing layers is heaped with an image receive sheet 2, e.g. plain paper, so that the printing layer 18 is faced with the surface of the receive sheet 2, and pressed or heated to transfer or adhere the printing layer 18 from the substrate 12 of the color ink film 1 onto the image receive sheet 2. In FIG. 1, the application of heat or pressure is carried out by passing between the heat rollers 5 and 6 which are pressed with each other under a certain pressure. The used color layer 19, for example, is passed between the heat rollers 5 and 6 and take up with a taken-up roller and the like. It is preferred that the system is constituted so that the color layer 19 does not touch the heat rollers 5 and 6 when the color layer 19 is passed between the rollers 5 and 6. The taken-up system of the color layers is not limited to the above mentioned system.

Needless to say, the printing head, the platen roller or the heat rollers 5 and 6 may be movable according to the movement of the color ink film. Also, a driving system between the platen roller 4 and the heat roller 6 is omitted in FIG. 1, but various rollers, such as pinch rollers, may be present.

Heating or pressing may be provided by passing the printing layer and the image receive sheet between mediums of which at least one is heated or between mediums which are pressed with each other. Heating may be carried out by a light source which has a high radiant heat. In FIG. 1, two heat rollers 5 and 6 are employed. The heat rollers may be rubber (silicone rubber, fluorine rubber, urethane rubber etc.) covered rollers, plastic rollers, metal rollers, Teflon-coated rollers and the like. The heating or pressing method is not limited as long as the printing layer is transferred onto the image receive sheet, but preferred is a combination of rollers of which at least one is a heat roller. More preferred is a combination of a resilient roller (rubber covered roller) and a metal roller under a certain pressure (e.g. a spring or air pressure), or a combination of two resilient rollers. One of the pressure or heat mediums may be a thermal head or an electrode head which transfers only a necessary portion (a printed portion) of the printing layer 18. A temperature of heating is not limited, but generally is within the range of room temperature to 300° C. An amount of pressure is not limited, but generally less than $10^8$ Pa/cm$^2$.

The transference of the printing layer 18 onto the image receive sheet 2 is done by fusing the printing layer 18 onto the surface of the image receive sheet 2 (e.g. plain paper) or by filling and softening it into the fiber of the paper by means of heat and/or pressure. For example, the substrate 12 of the color ink film 1 is peeled off from the printing layer 18 either upon passing it between the heat rollers 5 and 6 or, as shown in FIG. 1, after cooling it for the period of time between the heat rollers 5 and 6 and the rollers 40 and 41. In FIG. 1, the printing layer generally has a full color image using cyan, magenta and yellow and is transferred. If the three printing layers respectively have different color images, a full color printing can be carried out by transferring each printing layer three times on the same portion.

The color ink film 1 of the present invention may have functional layers, such as a polymer material layer, a ultraviolet light absorbing layer or an overcoat layer, other than the color layer and the printing layer. The functional layers, if necessary, may be also coated on the transferred printing layer. For example, a printing layer having no image may be transferred onto the transferred printing layer having an image. Also a polymer material layer may be formed on the transferred printing layer having one color image and the other two colors are repeated thereon. The functional layer may be a pigment ink layer. The pigment ink layer is printed by a printing head on the printing layer or directly on the substrate, and then transferred on the image receive sheet or on the transferred printing layer to form both a sublimed image and a melt type image.

Figure 2:
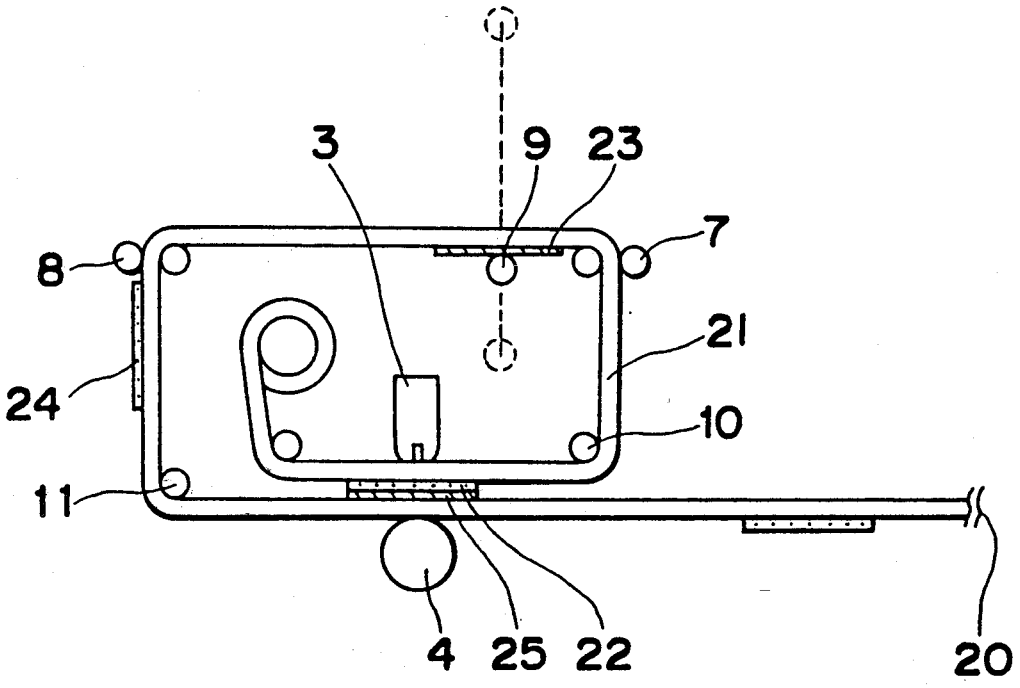
FIG. 2 is a partial schematic drawing which shows a printing portion of images on a printing layer in another embodiment of the method of the present invention.

FIG. 2 is a partial schematic drawing which shows a printing portion of images on a printing layer in another embodiment of the method of the present invention, in which the same portion as FIG. 1 is omitted. In this embodiment, both the color layer and the printing layer are present on the same substrate, but different from the first embodiment, the layers are respectively formed on a different side. A color ink film 20 has a color layer 22, a printing layer 23, a color layer 24, a printing layer 25 and so on in this order on a substrate 21, but the color layers 22, 24, . . . are present on one side of the substrate 21 and the printing layers 23, 25 . . . are present on the opposite side of the substrate from the color layers.

The printing process onto the printing layers is carried out by placing a color layer, e.g. color layer 22, on a printing layer, e.g. printing layer 25. As mentioned above, both layers are formed on different sides of the substrate 21, thus the color ink film is taken up in spiral form. In FIG. 2, the color ink film 20 starts between a printing head 3 and a platen roller 4 and passes via a roller 10, a speed control roller 7, an up-down movable roller 9, another speed control roller 8, another roller 11 and comes to the space between the printing head 3 and the platen roller 4, so that the color layer 22 is placed on the printing layer 25. Thus, the color ink film 20 is sandwiched in a certain pressure between the printing head 3 and the platen roller 4 and the dyestuff in the color layer is sublimated or diffused into the printing layer 25 to form an image on the printing layer 25. Although the printing head 3 is present on the substrate side of the color layer in FIG. 2, it may be present at the substrate side of the printing layer as required. The other explanation is omitted because it is the same as the explanation of FIG. 1.

In FIGS. 1 and 2, the printing layer is directly formed on the substrate, but a releasing layer or a polymer material layer or both may be present between the substrate and the printing layer. The same process can be applied to this plural layers construction.

Figure 3:
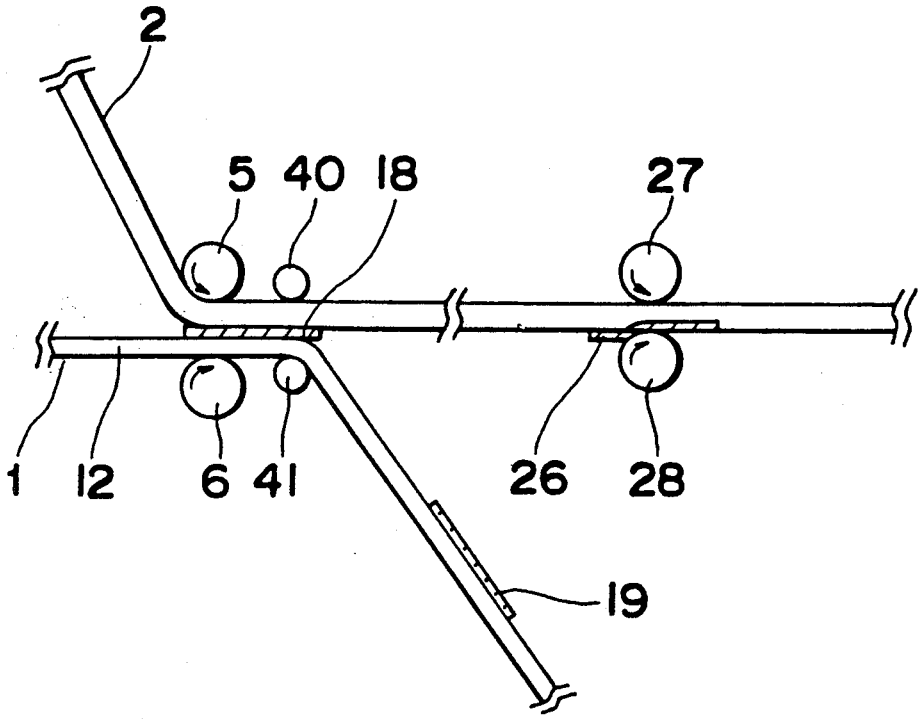
FIGS. 3 and 4 are drawings which schematically show the transferring of the printing layer and the fixing thereof on the image receive sheet of the method of the present invention.
Figure 4:
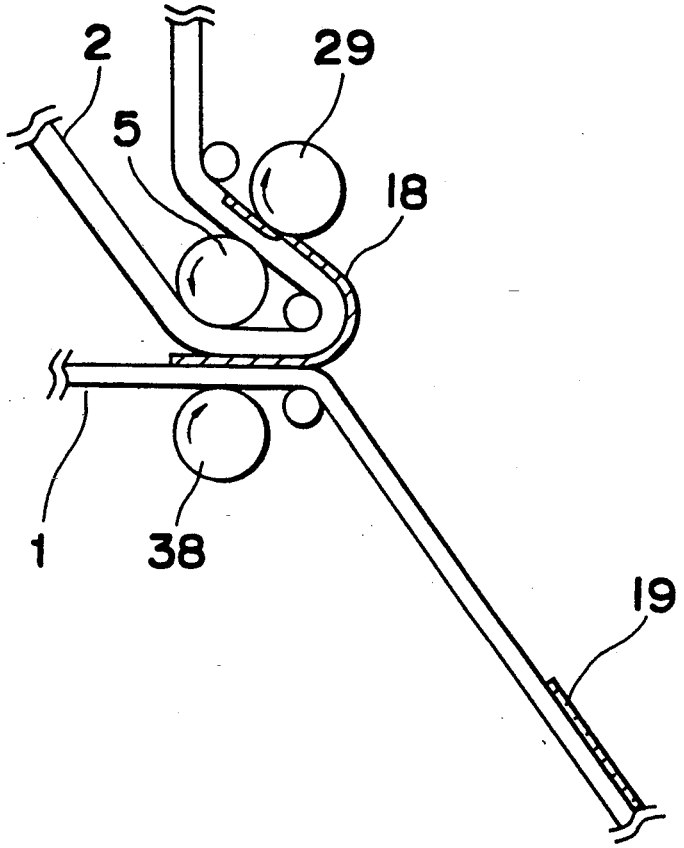

Subsequently, the second printing method is explained. FIGS. 3 and 4 are drawings which schematically show the transferring of the printing layer and the fixing thereof on the image receive sheet of the method of the present invention. FIGS. 3 and 4 omit the portion of the printing process from the color layer onto the printing layer and only show the transferring and the fixing process of the printing layer 18 onto the image receive sheet 2.

In FIG. 3, the printing layer 18 which has an image passes through between the heat rollers 5 and 6 under pressure and then is released from the substrate 12 and transferred onto the image receive sheet 2 at the position of the roller 41. Then, the printing layer 26 on the image receive sheet 2 is fixed under pressure between the heat roller 27 and the silicone rubber-covered roller 28. If the receive sheet 2 is porous like plain paper, the printing layer 26 is forced into or filled in the paper fibers and reduces its glossy appearance, thus the existing feeling of the printing layer on the image receive sheet 2 would disappear. Accordingly, no difference between the printed paper surface and the non-printed paper surface appears when observed by the eyes and this process is considered as a desirable printing method on plain paper.

FIG. 4 shows an embodiment in which the heat roller 5 is commonly employed as one of the fixing rollers to reduce the number of rollers, because it increases the number of rollers that the heat roller is different from the fixing roller as shown in FIG. 3. Thus, in FIG. 4, the heat roller 5 and the silicone rubber-covered roller 38 constitute the roller combination of the transferring portion, and the heat roller 5 and the silicone rubber-covered roller 29 constitute the roller combination of the fixing portion. In FIGS. 3 and 4, the combination of a heat roller and a silicone rubber-covered roller is employed, but the invention is not limited to this. Also, in this embodiment, rollers are employed, but they are not limited as long as the printing layer is transferred onto the image receive sheet by heat and/or pressure. For example, the image receive sheet is passed between mediums of which at least one is heated or between mediums which are pressed with each other. Also, a sucking medium may be provided on the side of the image receive sheet. Heating may be carried out by a light source which has a high radiant heat. The rollers or heat rollers may be rubber (silicone rubber, fluorine rubber, urethane rubber, etc.) covered rollers, plastic rollers, metal rollers, Teflon-coated rollers and the like. The heating or pressing medium also can have a plate like shape and may be a heat printing head. Heating may be conducted with various heating means, such as a halide lamp a nichrome wire and the like. The combination of two rollers of which at least one roller is heated by, for example, a halide lamp and pressured is preferred. The heating or pressing method is the same as FIG. 1. A temperature of heating is not limited, but is generally within the range of room temperature to 300° C. An amount of pressure is not limited, but generally is less than $10^8$ Pa/cm$^2$.

In FIGS. 3 and 4, the printing layer is directly formed on the substrate, but a releasing layer or a polymer material layer or both may be present between the substrate and the printing layer. The same process can be applied to this plural layers construction.

Figure 5:
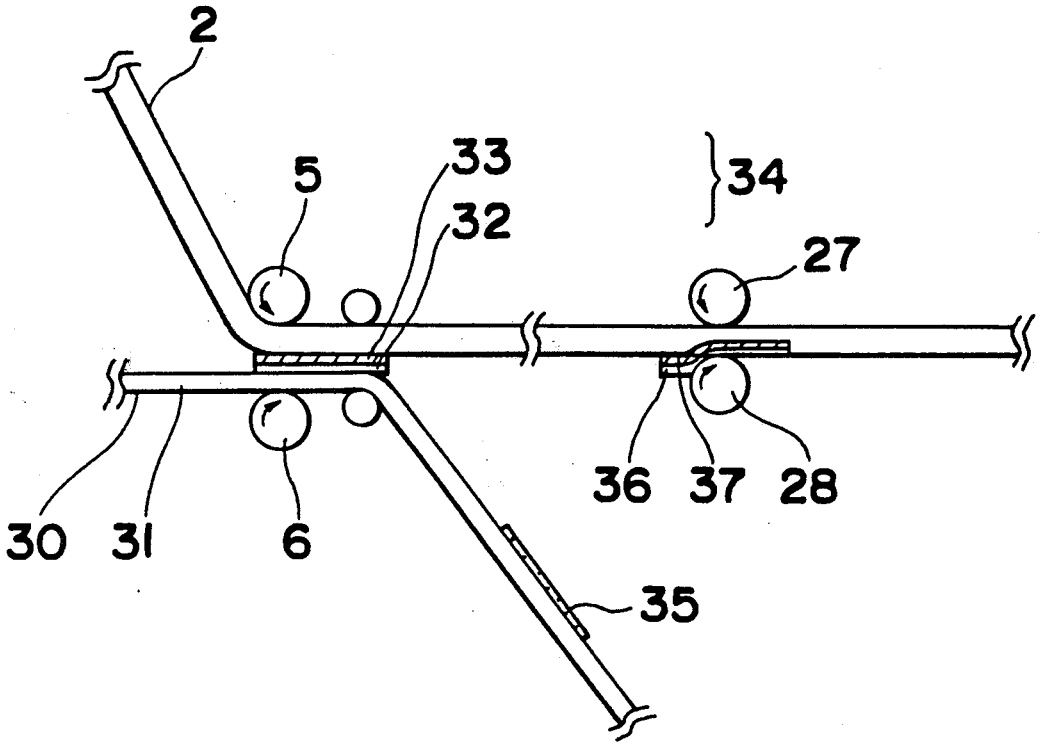
FIG. 5 is a drawing which schematically shows the transferring of the printing layer and the fixing thereof on the image receive sheet of another embodiment of the method of the present invention.

FIG. 5 is a drawing which schematically shows the transferring of the printing layer and the fixing thereof on the image receiver of another embodiment of the method of the present invention. A color ink film 30 has a color layer 35 and a laminate 34 of a polymer material layer 32 and a printing layer 33. The color layer 35 has been used for printing. The laminate 34 is passed through between heat rollers 5 and 6 under pressure to transfer onto the image receive sheet 2, and then pressured by a heat roller 27 and a silicone rubber-covered roller 28 to fix on the receive sheet 2.

The third embodiment of the present invention is a method wherein the color ink film 1 having the printing layer with an image to be printed is placed on the image receive sheet 2 to integrate the film 1 and sheet 2, which is different from the first and second embodiments wherein only the printing layer is transferred onto the image receive sheet 2.

Figure 6:
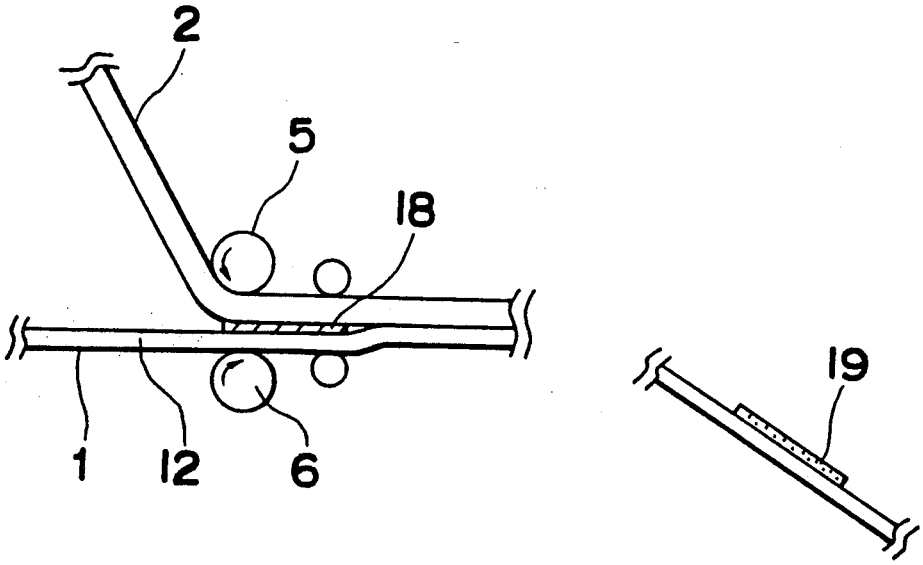
FIG. 6 is a drawing which schematically shows an integration of the color ink film and the image receive sheet in an embodiment of the printing method of the present invention.

FIG. 6 is a drawing which schematically shows an integration of the color ink film and the image receive sheet in an embodiment of the printing method of the present invention. FIG. 6 omits the portion of the printing process from the color layer onto the printing layer and only shows the integrating process of the color ink film 1 with the printing layer 18 onto the image receive sheet 2 under pressure by passing through between the heat rollers 5 and 6. Since the color ink film is integrated with the receive sheet in this embodiment, it is required that the unnecessary portion in the color ink film, such as a portion with the color layers, is removed. The printing layer 18 is described as a single layer, but can be a laminate, including a polymer material layer, a releasing layer and the like.

The substrate of the color ink film in the integrated receive sheet can act as a protective layer of the printed images. It is therefore unnecessary to form another protective layer. The substrate of the color ink film may be removed from the integrated receive sheet if necessary. It is preferred that, if a releasing layer is present between the printing layer and the substrate in the color ink film, the substrate can be easily removed from the integrated receive sheet.

The color ink film of the present invention comprises a substrate, and a color layer and a printing layer respectively formed on the substrate in a certain interval of distance without putting one upon another. A releasing layer and/or a polymer material layer may be present between the printing layer and the substrate, if necessary.

The surface material or surface characteristics of the substrate may be different between the color layer contact surface and the printing layer contact surface, or between the color layer contact surface and the releasing layer contact surface. For example, when a color layer is formed on the surface, it is preferred that an anchor coat layer is formed on a polymer film and the color layer is formed thereon to improve the adhesive properties between the substrate and the color layer. This surface treatment is more necessary for the color ink film of the present invention, because it is preferred that the adhesive properties between the substrate and the color layer are strong and that the adhesive properties between the printing layer and the substrate is sufficient not to peel off when printing an image and is sufficient to peel when transferring the printing layer onto the image receive sheet. It is also preferred that either the color layer or the printing layer or both layers contain a releasing agent, such as a silicone type releasing agent or a fluorine type releasing agent. The image receive sheet 2 is not limited in material, quality and shape, including non-coated paper, coated paper, film, sheet, synthetic paper, continuous sheet or cut sheet. The image printed in the receive sheet 2 is a mirror image to the image printed on the printing layer, because the printing layer is transferred onto the receive sheet 2. Accordingly, the informations to be sent to the printing head should take into consideration this mirror image.

According to the present invention, printing photographic images can be possible on various kinds of paper, such as plain paper, transparent film for OHP, bond paper, coated paper and non-coated paper. Especially, printed images having high quality are obtained on plain paper using simple elements (i.e. a color ink film and an image receive sheet) according to the present invention.

FIGS. 7–19 are sectional views which schematically show several embodiments of the color ink films of the present invention.

Figure 7:
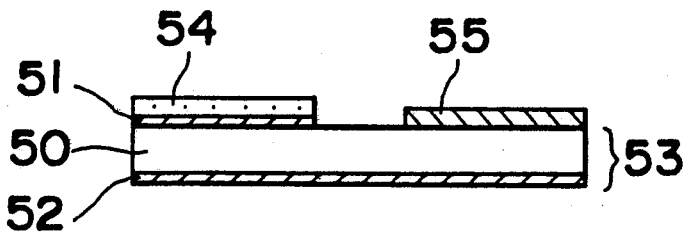
FIGS. 7–19 are sectional views which schematically show several embodiments of the color ink films of the present invention.
Figure 8:
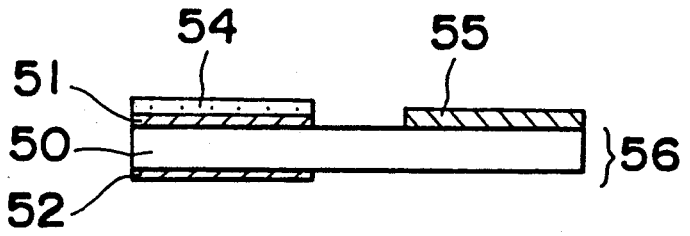
Figure 9:
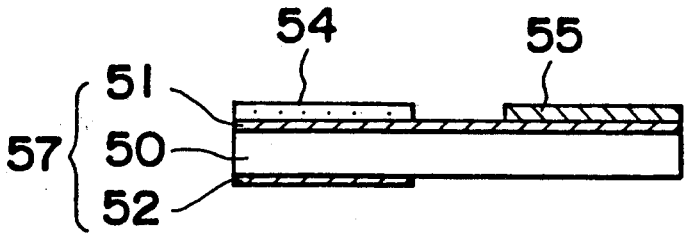

FIGS. 7, 8 and 9 are the simplest embodiments. In FIG. 7, a color layer 54 and a printing layer 55 are formed on the same side of a substrate 53 and the opposite side of the substrate has a lubricating heat resistant layer 52. In this embodiment, an anchor coat layer 51 is also present between a polymer film 50 and the color layer 54. In FIG. 8, a color layer 54 and a printing layer 55 are formed on the same side of a substrate 56 and the opposite side of the substrate has a lubricating heat resistant layer 52, on the side of the color layer 54. In this embodiment, an anchor coat layer 51 is also present between a polymer film 50 and the color layer 54. In FIG. 9, a color layer 54 and a printing layer 55 are formed on the same surface of a substrate 57 which has an anchor coat layer 51 formed on a polymer film 50, and the opposite side of the substrate has a lubricating heat resistant layer 52.

Figure 10:
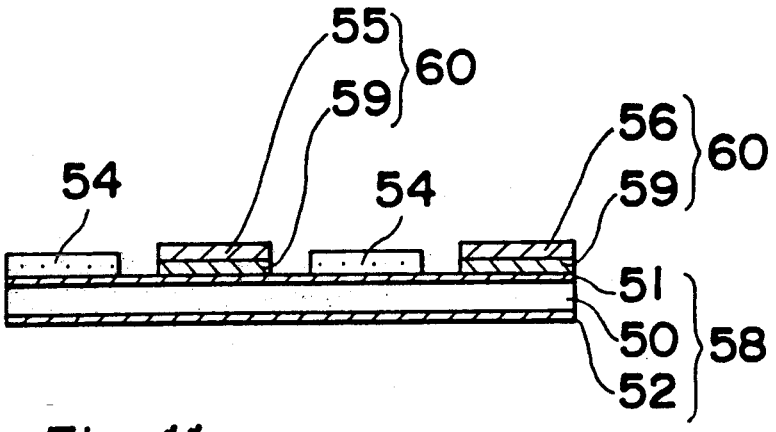

FIG. 10 shows an embodiment in which a releasing layer 59 is present between the printing layer 55 and the substrate 58 (or the anchor coat layer) to form a laminate layer 60.

Figure 11:
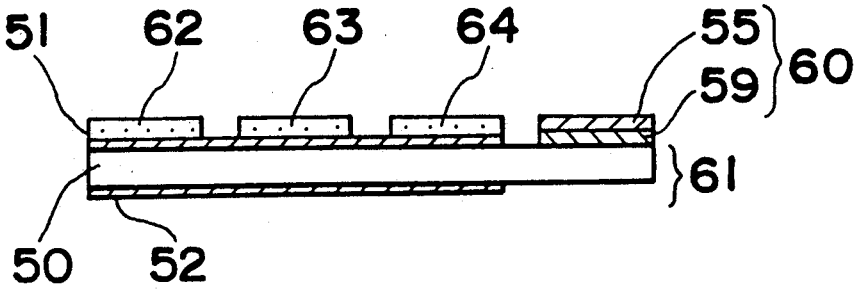

FIG. 11 shows an embodiment in which the color layer is divided into three color layers, i.e. a cyan color layer 62, a magenta color layer 63 and a yellow color layer 64 and a releasing layer 59 is present between the printing layer 55 and the substrate 61.

Figure 12:
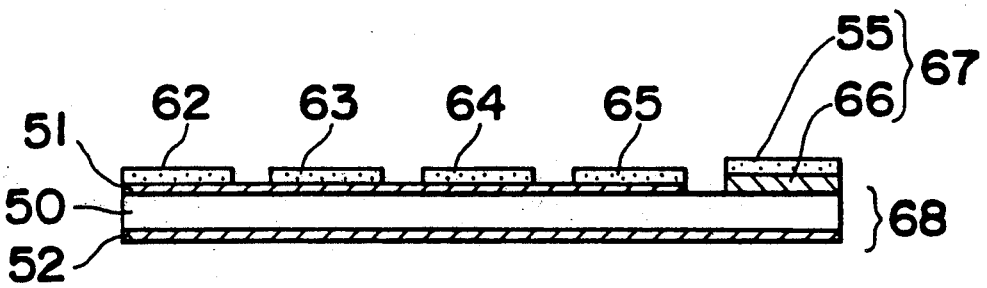

FIG. 12 shows an embodiment in which a substrate having an anchor coat layer 51 on a portion of one side and a lubricating heat resistant layer 52 on the other side is formed, and four color layers (i.e. cyan color layer, magenta color layer, yellow color layer and black color layer) and a laminate layer 67 (including a polymer material layer 66 and a printing layer 55) are formed on the anchor coat layer side.

Figure 13:
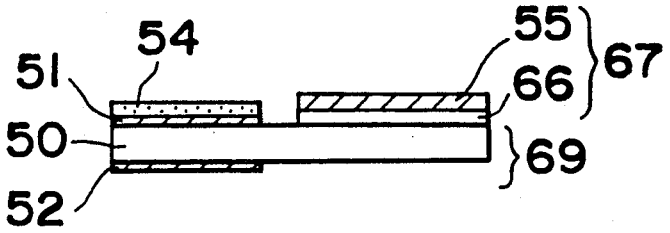

FIG. 13 shows an embodiment in which a substrate having an anchor coat layer 51 on a portion of one side and a lubricating heat resistant layer 52 on a portion of the other side is formed, and a color layer and a laminate layer 67 (including a polymer material layer 66 and a printing layer 55) are formed on the anchor coat layer side.

Figure 14:
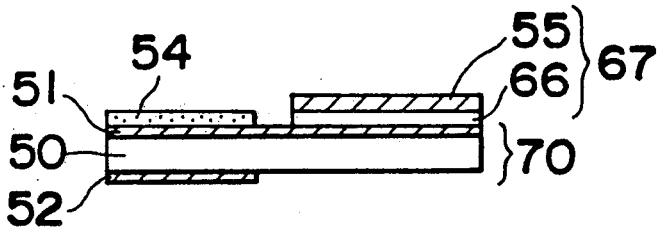

FIG. 14 shows an embodiment in which a substrate having an anchor coat layer 51 on one side and a lubricating heat resistant layer 52 on a portion of the other side is formed, and a color layer and a laminate layer 67 (including a polymer material layer 66 and a printing layer 55) are formed on the anchor coat layer side.

Figure 15:
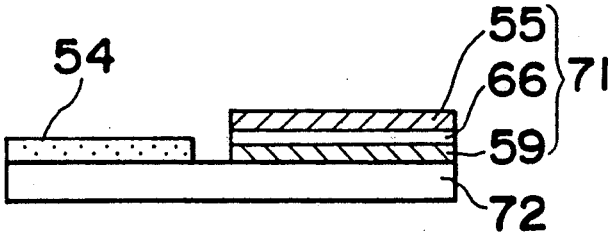

FIG. 15 shows an embodiment in which a color layer and a laminate layer 71 (including a releasing layer 59, a polymer material layer 66 and a printing layer 55) are formed on the same side of a substrate 72 which do not have an anchor layer and a heat resistant layer.

Figure 16:
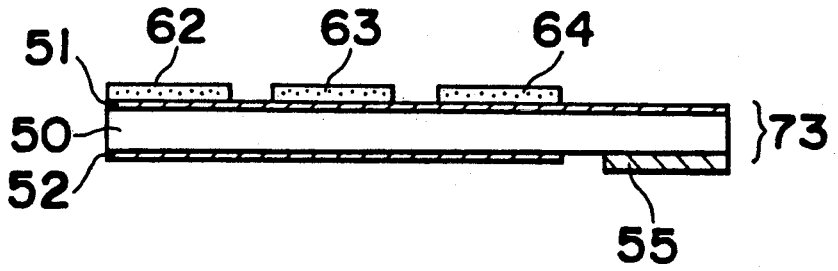

FIG. 16 shows an embodiment in which one side of a substrate 73 has a color layer 62, 63 and 64 (i.e. a cyan layer, a magenta layer and a yellow layer), the other side of it has a printing layer 55, an anchor layer 51 is present between a polymer film 50 and the color layer and the backside of the polymer film has a heat resistant layer 52.

Figure 17:
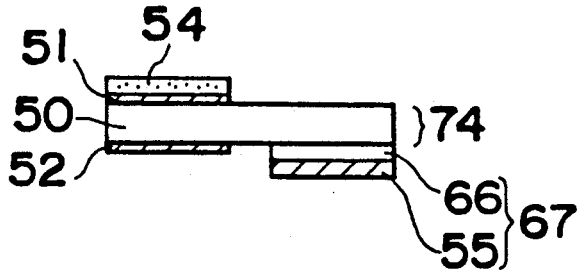

FIG. 17 shows an embodiment in which one side of a substrate 74 has a color layer 54, the other side of it has a polymer material layer 66 and a printing layer 55, an anchor layer 51 is present between a polymer film 50 and the color layer and the backside of the polymer film has a heat resistant layer 52.

Figure 18:
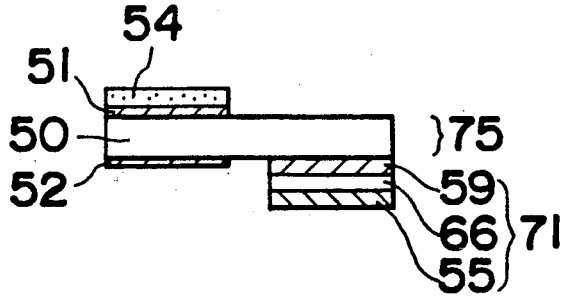

FIG. 18 shows an embodiment in which one side of a substrate 75 has a color layer 54, the other side of it has a releasing layer 59, a polymer material layer 66 and a printing layer 55, an anchor layer 51 is present between a polymer film 50 and the color layer and the backside of the polymer film has a heat resistant layer 52.

Figure 19:
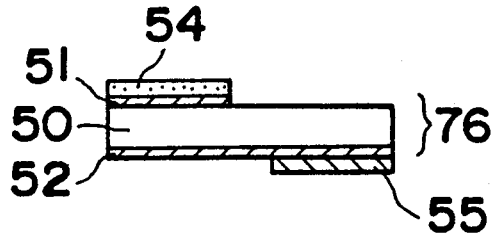

FIG. 19 shows an embodiment in which one side of a substrate 76 has a color layer 54, the other side of it has a printing layer 55, an anchor layer 51 is present between a polymer film 50 and the color layer and the backside of the polymer film has a heat resistant layer 52 which is also extended to between the polymer film 50 and the printing layer 55.

The present invention provides a color ink film which comprises a substrate and a color layer and a printing layer respectively formed on the substrate in a certain interval of distance without putting one upon another, wherein either the color layer or the printing layer or both are formed from polyvinyl butyral having a butyralization degree of not less than 50 mol %. If one is formed from polyvinyl butyral, the other is a polymer other than polyvinyl butyral, including acrylonitrile-styrene copolymer resin, polystyrene, styrene-acryl copolymer resin, chlorinated rubber, vinyl chloride resin, chlorinated vinyl chloride resin, vinyl acetate, vinyl chloride-vinyl acetate copolymer resin, vinyl chloride-acrylate copolymer resin, saturated polyester resin, polyester-urethane, polycarbonate, chlorinated polypropylene, cellulose resin or a mixture thereof. The printing layer may be prepared from a combination of a fluorine-containing moisture curable resin or a siloxane-containing moisture curable resin and a resin selected from the group consisting of acrylonitrile-styrene copolymer resin, polystyrene, styrene-acryl copolymer resin, chlorinated rubber, vinyl chloride resin, chlorinated vinyl chloride resin, vinyl acetate, vinyl chloride-vinyl acetate copolymer resin, vinyl chloride-acrylate copolymer resin, saturated polyester resin, polyester-urethane, polyvinyl acetal, polycarbonate, chlorinated polypropylene, cellulose resin or a mixture thereof. The printing layer may be a laminate of a polymer material layer and a printing layer. In this case, the adhesive strength between the polymer material layer and the printing layer is larger than that between the substrate and the polymer material layer. The printing layer may be a laminate of a releasing layer, a polymer material layer and a printing layer in this order from the substrate. The printing layer (or a laminate) may be present on the different surface of the color layer.

The substrate can be formed from a material which is known to the art, including a polymer film, a surface treated polymer film, an electroconductive film and the like. Examples of the polymer films are polyolefin, polyamide, polyester, polyimide, polyether, cellulose, poly(parabanic acid), polyoxadiazole, polystyrene, fluorine-containing film and the like. Preferred are polyethylene terephthalate, polyethylene naphthalate, aromatic polyamide, triacetyl cellulose, poly(parabanic acid), polysulfone, polypropylene, cellophane, moistureproof cellophane and polyethylene. It is preferred that at least one side of the substrate is covered with a heat resistance layer, a lubricant layer (or a lubricant electroconductive layer) and a lubricant heat resistance layer (or a lubricant heat resistance electroconductive layer) to enhance heat resistance and traveling stability of the color ink film. For example, as shown in FIG. 7, the substrate 53 may have a lubricant heat resistance layer 52 on one side and an anchor coat layer 51 on a portion of the other side. The lubricant heat resistance layer 52 enhances a traveling stability between the printing heat (e.g. a thermal head) and the color ink film and the anchor coat layer 51 enhances adhesive properties between the polymer film 50 and the color layer 54. As shown in FIG. 8, the substrate 56 may have a lubricant heat resistance layer 52 on a portion of one side and an anchor coat layer 51 on a portion of the other side. Also, as shown in FIG. 9, the substrate 57 may have a lubricant heat resistance layer 52 on a portion of one side and an anchor coat layer 51 on the other side. Especially in FIG. 9, since the anchor coat layer is provided between the polymer film 50 and the printing layer, the color ink film is suitable for the embodiment of integrating the color ink film and the image receive sheet. Examples of the electroconductive films are a polymer film containing electroconductive particles (e.g. carbon black or metal powder), a polymer film on which an electroconductive layer is formed, a polymer film on which an electroconductive vapor deposition layer is formed, and the like. In case of the embodiment of integrating the color ink film and the image receive sheet, it is preferred that the substrate is transparent.

The thickness of the substrate is not limited, but generally is within the range of 2 to 30 micrometers. The thinner the thickness of the substrate, the better, if there are no problems in treatment. The thin substrate enhances printing sensitivity and increases a color ink film content in a film cassette. Also in case of the embodiment of integrating the color ink film and the image receive sheet, the thin substrate may enhance transparency. The thickness of the substrate may have ununiformity in some degree between the portion of the color layer and the portion of the printing layer.

The color layer is mainly composed of a color material and a binder. The color material is not limited, including a disperse dye, a basic dye, a color former and the like. The binder includes acryl resins, styrene resins, urethane resins, polyester resins, polyvinyl acetal resins, vinyl acetate resins, chlorinated resins, amide resins, cellulose resins and the like. Examples of the cellulose resins are methyl cellulose, ethyl cellulose, hydroxyethyl cellulose, carboxymethyl cellulose, nitrocellulose, acetic cellulose and the like. Preferred binders are acrylonitrile-styrene copolymer, polystyrene, styrene-acryl copolymer, saturated polyester, polyester-urethane, vinyl chloride resin, chlorinated vinylchloride resin, vinyl chloride-vinyl acetate copolymer (which is further copolymerized with vinyl alcohol, maleic acid and the like), vinyl chloride-acrylate copolymer (of which acrylate may be a mixture), vinyl acetate resin, rubber chloride, chlorinated polypropylene, polycarbonate and cellulose resins, because printing sensitivity is high and they effectively prevent the color layer from fusing. The copolymer may be prepared from three monomers. The binder may also be polyvinyl acetals, such as polyvinyl formal, acetoacetalized polyvinyl alcohol, propionacetalized polyvinyl alcohol, polyvinyl butyral and the like. It is preferred that the binder has a glass transition temperature of 40° to 180° C. and an average polymerization degree of 200 to 2,700.

The color layer may further contain fluorine-containing moisture curable resins or siloxane-containing moisture curable resins to prevent heat fusing. The fluorine-containing moisture curable resins or siloxane-containing moisture curable resins include moisture curable resins which contain hydrolyzable silyl groups (see Japanese Patent Application Ser. No. 144241/1988); and moisture curable resins which contain hydrolyzable isocyanate groups into which fluorine or silicone is introduced. The fluorine-containing moisture curable resins include fluorine-containing polymer having hydrolyzable silyl groups, for example moisture curable resins as described in Japanese Kokai Publication 558/1987, especially fluorine-containing acrylsilicon resin; or fluorine-containing polyurethane resin having hydrolyzable isocyanate group at terminals or side chains. The siloxane-containing moisture curable resins includes siloxane-containing vinyl polymers having hydrolyzable silyl groups, especially siloxane-containing acryl silicon resins; or siloxane-containing polyurethane resins having hydrolyzable isocyanate groups at terminals or side chains. The fluorine-containing moisture curable resins or siloxane-containing moisture curable resins may be modified with urethane resins. Examples of the fluorine-containing acryl silicon resins are fluorine-containing acryl silicon resins available from Sanyo Chemical Industries Ltd. as F-2A. Examples of the siloxane-containing acryl silicon resins are siloxane-containing acryl silicon resin available from Sanyo Chemical Industries Ltd. as F-6A. Examples of the siloxane-containing moisture curable resins having hydrolyzable isocyanate groups are siloxane-containing moisture curable resins available from Shinko Technical Research CO., LTD. as SAT-300P.

The color layer may further contain a reaction promoter for the moisture curable resin, if necessary. Examples of the reaction promoters are titanates (e.g. alkyl titanate), amines (e.g. dibutylamine-2-hexoate), organic tin compounds (e.g. tin octylate, dibutyltin dilaurate, dibutyltin maleate), acidic compounds and catalysts as described in Japanese Kokai Publication 19361/1983. An amount of the reaction promoter is within the range of 0.001 to 100% by weight based on the amount of the resin.

The color layer may also contain a storage stabilizer in case where the moisture curable resin is used as a coating composition. Examples of the storage stabilizers are as described in Japanese Kokai Publication 51724/1985 and 147511/1982.

The color layer is composed of plural layers. Also, a lubricating layer or other layer may be formed on the color layer. The uppermost layer may preferably contain the fluorine-containing moisture curable resins, siloxane-containing moisture curable resins, or the other silicone or fluorine materials or antistatic agents.

The printing layer is generally formed from polymer material and may contain a color developer, such as an electron accepting material if the color layer contains a leuco dye. Examples of the electron accepting materials are phenols (e.g. bisphenol A), carboxylic compounds, silica, activated clay and the like. The polymer material for the printing layer can be the same as explained for the binder of the color layer, including acryl resin, styrene resin, urethane resin, polyester resin, polyvinyl acetal, vinyl acetate, amide resin, cellulose resin, chlorinated resin and the like. Preferred resins are acrylonitrile-styrene copolymer resin, polystyrene, styrene-acryl copolymer resin, saturated polyester, polyester-urethane, chlorinated rubber, vinyl chloride resin, chlorinated vinyl chloride resin, vinyl chloride-vinyl acetate resin (which may contain vinyl alcohol, maleic acid and the other monomers), vinyl chloride-acrylate copolymer (in which the acrylate may be a combination of plural acrylates), vinyl acetate resin, polycarbonate, chlorinated polypropylene and cellulose resin, which enhances printing sensitivity and heat-fusion proofing properties with the color layer. It is preferred that the polymer material has a glass transition temperature of 40° to 150° C. and an average polymerization degree of 200 to 2,700. In order to transfer the printing layer onto the image receive sheet or to fix the resin of the printing layer into the image receive sheet (e.g. porous paper), it is preferred that the polymer material has an average polymerization degree of 1,500 or less or has a flow softening point of 200° C. or less. Since the printing layer is transferred onto the image receive sheet, it is desired that the printing layer is transparent, thus the polymer material being transparent.

The printing layer is preferably prepared from polyvinyl acetal. The polyvinyl acetal is a resin which is prepared by reacting polyvinyl alcohols with aldehydes (e.g. formaldehyde, acetoaldehyde, propionaldehyde, butylaldehyde and the like). Typical examples of the polyvinyl acetals are polyvinyl formal, acetoacetalized polyvinyl alcohol, propionacetalized polyvinyl alcohol, polyvinyl butyral and the like. The polyvinyl acetal has superior dyeing ability for a disperse dye, because it has polar groups which are acetal constructions. The acetal construction has a hydrogen atom or an alkylidene group which is non-polar groups. It is preferred that the polyvinyl acetal has a high acetalization degree and the alkylidene group has 3 carbon atoms or more, because such polyvinyl acetal effective by prevents heat fusion. Also, the polyvinyl acetal having high acetalization degree and an alkylidene group having at least three carbon atoms has a low glass transition temperature, thus resulting in high printing sensitivity.

The polyvinyl acetal preferably has an average polymerization degree of 2,700 or less, more preferably less than 1,500, in view of printing sensitivity and transferring properties. It is also preferred that the polyvinyl acetal has a flow softening point of 250° C. or less, more preferably 200° C. or less. The flow softening point (or flow beginning temperature) is determined by a flow tester (temperature rise rate=6° C./min, extruding pressure=$9.8\times10^6$ Pa/cm$^2$, die=1 mm (diameter)×10 mm). The polyvinyl acetal which satisfies the range mentioned above has good printing sensitivity and good transferability to the image receive sheet. Since the polyvinyl acetal which has a higher acetalization degree exhibits higher heat fusion prevention properties, it is desired that the acetalization degree is 50 mol % or more. It is most preferred that the polyvinyl acetal is polyvinyl butyral which has a butyralization degree of 50 mol % or more, because it has excellent heat fusion preventive properties and printing sensitivity. Suitable polyvinyl butyral is commercially available from Sekisui Chemical Co., Ltd. as BL-1 (butyralization degree=63±3 mol %, flow softening point=105° C.), BL-2 (butyralization degree=63±3 mol %, flow softening point=120° C.), BH-S (butyralization degree=70 mol % or more, flow softening point=160° C.), BM-S (butyralization degree=70 mol % or more, flow softening point=150° C.), BL-S (butyralization degree=70 mol % or more, flow softening point=110° C.), BH-3 (butyralization degree=65±3 mol %, flow softening point=205° C.), BM-2 (butyralization degree=68±3 mol %, flow softening point=140° C.), BM-1 (butyralization degree=65±3 mol %, flow softening point=130° C.), BM-5 (butyralization degree=65±3 mol %, flow softening point=160° C.) and the like. The polyvinyl acetal may be reacted with phenol resin, epoxy resin, melamine resin, isocyanate compound or dialdehyde compound to form a crosslinked structure. The polyvinyl acetal has no stickiness at an ambient temperature and therefore has no bleeding and is easily treated.

Since the polyvinyl acetal has poor adhesive properties with polyester film (e.g. polyethylene terephthalate film), it is easily removable from the polyester substrate. However, when printing the printing images on the printing layer, the printing layer is heated more than the glass transition temperature and softened. Even in the softened condition, the polyvinyl acetal has insufficient adhesion to adhere to the thermal ink film. It is believed that this is the reason why the polyvinyl acetal remains on the substrate when printing. Once printing has finished, the polyvinyl acetal layer contains dye and lowers its softening point in comparison with that not containing dye. Accordingly, when the polyvinyl acetal layer is contacted with the image receive sheet, it is easily adhered onto the sheet. If the image receive sheet is plain paper, the polyvinyl acetal is coiled with the paper matrix to promote the transferring. This is the reason why the polyvinyl acetal layer is stuck on the substrate when printing by the printing head and transferred onto the image receive sheet in the next transferring step. Since the polyvinyl acetal which has a higher acetalization degree exhibits higher heat fusion prevention properties, it is desired that the binder of the color layer has an acetalization degree of 50 mol % or more. It is most preferred that either the color layer or the printing layer is formed from polyvinyl butyral which has a butyralization degree of 50 mol % or more and the other is formed from other polymer material, because it has excellent heat fusion preventive properties. For this purpose, the polymer material preferably is acrylonitrile-styrene copolymer, polystyrene, styrene-acryl copolymer resin, saturated polyester, polyester-urethane, chlorinated rubber, vinyl chloride resin, chlorinated vinyl chloride resin, vinyl acetate resin, vinyl chloride-vinyl acetate resin, vinyl chloride-acrylate resin, polycarbonate, chlorinated polypropylene, cellulose resin and the like.

In addition to the main components, the printing layer may also contain fluorine-containing moisture curable resins or siloxane-containing moisture curable resins to prevent heat fusion. Examples of the fluorine-containing moisture curable resins or siloxane-containing moisture curable resins are the same as mentioned in the color ink film. The addition of the fluorine-containing moisture curable resins or siloxane-containing moisture curable resins is very preferred, because the heat fusion between the color ink film and the printing layer would not occur. The printing layer may further contain other resins, such as acryl resins, urethane resins, polyester resins, vinyl acetate resins, chlorinated resins, styrene resins, cellulose resins and the like. Preferred are acrylonitrile-styrene copolymer resin, polystyrene, styrene-acryl copolymer resin, saturated polyester, polyester-urethane, vinyl chloride resin, chlorinated vinyl resin, rubber chloride, chlorinated polypropylene, polycarbonate, vinyl chloride-vinyl acetate resin, vinyl chloride-acrylic ester copolymer and vinyl acetate resin. Preferably the printing layer is formed from a combination of the polyvinyl acetal which has high heat fusion preventive properties and the fluorine-containing moisture curable resins or siloxane-containing moisture curable resins, because it exhibits excellent heat fusion preventive properties with the color layer.

If necessary, either a polymer material layer 66 or a releasing layer 59 or both may be disposed between the substrate and the printing layer. The polymer material layer is prepared from thermoplastic resins or curable resins by means of heat, light or electron beam. The polymer material includes acryl resins, urethane resins, amide resins, ester resins, cellulose resins, styrene resins and the like. The curable resin includes an acrylate resin, such as polyester acrylate, epoxy acrylate, urethane acrylate, silicone acrylate etc.; an unsaturated cycloacetal compound; or an epoxy compound. It is desired that the resin is water soluble or water dispersible, because these resins have good solvent resistance. Preferred polymer materials are polyvinyl alcohol, polyvinyl alcohol derivatives, cellulose derivatives, modified starch, starch derivatives, chlorinated resin and polycarbonate, because they have good solvent resistance to aromatic hydrocarbons or ketones which are used for the printing layer and have poor adhesive properties with polyester films which are typically used for the substrate. Examples of the polyvinyl alcohol derivatives are polyvinyl acetal and the like. Examples of the cellulose derivatives are methyl cellulose, ethyl cellulose, hydroxyethyl cellulose, carboxymethyl cellulose, nitrocellulose, acetic cellulose and the like. Examples of the processed starches are oxide starch, enzyme-treated starch and the like. Examples of the starch derivatives are hydroxyethyl starch, carboxymethyl starch, cyanoethylated starch and the like. Examples of the chlorinated resins are rubber chloride, chlorinated polyethylene, chlorinated polypropylenee and the like. These polymers are not sticky at an ambient temperature and have no bleeding properties. The polymer material preferably has a glass transition temperature of more than 50° C. in view of the reliability of the printed images. In order to coil the polymer material into the paper matrix, the polymer material preferably has an average polymerization degree of 200 to 2,700, more preferably 200 to 1,500 or a flow softening point of 80° to 250° C., more preferably 80° to 200° C. The polymer material may further contain the fluorine-containing moisture curable resins or siloxane-containing moisture curable resins to prevent heat fusion. Since the polymer material layer is transferred to the image receive sheet together with the printing layer, it is preferred that the layer is transparent. Thus, the above mentioned component is preferably transparent. The polymer material layer controls adhesive properties between the substrate and printing layer or between the releasing layer and the printing layer, or functions as an undercoat for the printing layer. Once transferred onto the image receive layer, the polymer material layer functions as a protective layer for light-resistance or wear resistance or exhibits good writing properties for pencils, because the layer is present as the uppermost layer. The polymer material layer may be constituted from more than two layers and can be a coated or hot-molten layer or polymer film.

The releasing layer 59 mainly contains a releasing agent or a combination of the releasing agent and a polymer binder. The releasing agent includes the fluorine-containing moisture curable resins, siloxane-containing moisture curable resins, other silicone releasing agents and fluorine releasing agents. The fluorine-containing moisture curable resins or siloxane-containing moisture curable resins are the same as mentioned above. Typical examples of the other silicone releasing agents are dimethylsilicone oil, phenylsilicone oil, fluorine-containing silicone oil, modified silicone oil (e.g. modified with SiH, silanol, alkoxy, epoxy, amino, carboxyl, alcohol, mercapt, vinyl, polyether, fluorine, higher fatty acid, carnauba, amide or alkylallyl), silicone rubber, silicone resin, silicone emulsion and the like. Typical examples of the other fluorine releasing agents are fluorine resins (e.g. polytetrafluoroethylene, tetrafluoroethylene-perfluoroalkyl vinyl ether copolymer), fluorine rubbers (e.g. vinylidene fluoride-hexafluoropropylene rubber), fluorine surfactants, fluoride carbons, fluorine rubber latex and the like. The releasing agent also includes fatty acid esters, waxes and oils. The polymer binder can be the polymer listed in the polymer material layer 66. If necessary, an adhesive layer may be disposed between the substrate and the releasing layer. It is also desired in case of the embodiment of integrating the color ink film and the image receive sheet that the releasing layer be transparent.

The releasing layer 59 and the polymer material layer 66 may contain antistatic agents.

The color layer, the printing layer or the polymer material layer may contain one or more releasing agents. The releasing agent is the silicone or fluorine releasing agent as described in the releasing layer. The printing layer or the polymer material layer is required to have writing properties and therefore may contain micro particles, such as synthetic amorphous silica, titanium oxide, calcium carbonate, alumina; or transparent micro particles. Especially, if the printing layer (or the polymer material layer and printing layer) is fixed into inside of the paper fibers, sufficient writing properties are obtained without the micro particles. In this case, the particles of course can be formulated. In case of the embodiment of integrating the color ink film and the image receive sheet, the substrate is adhered on the image receive sheet and it is preferred that the substrate has writing properties. For example, a roughened film or a coated film can be used as the substrate.

The printing layer (or the polymer material layer) may further contain an ultraviolet absorber, an antioxidant and a fluorescent agent to improve light-resistance of printed images. Since the polymer material layer functions as protective layer after transferred, it is more preferred that the layer contains the ultraviolet absorber, the antioxidant and the like. In case of the embodiment of integrating the color ink film and the image receive sheet, the substrate or the releasing layer functions as a protective layer of the printed images and preferably contains the ultraviolet absorber or the antioxidant or has a layer containing the same. The polymer material layer may be a dyeable or color developing layer.

The color layer, the printing layer, the releasing layer or the polymer material layer may further contain antistatic agents. The color layer or the releasing layer may contain micro particles. The color ink film may have a transferable layer (e.g. a white hiding layer, a tacky layer and a pigment ink layer), a nontransferable layer or a laminated layer.

The image receive sheet is not limited in raw material, properties and shape, and can be non-coated paper, coated paper, film, sheet, synthetic paper, continuous receive sheet or cut receive sheet.

The present invention provides a thermal printing method using a sublimable dye or a color ink film, which is capable of faithfully printing on any kind of substrates, including plain paper, transparent film for OHP, bond paper having surface roughness, coated paper and coated film, without the tack sheets which make the process complicated.

EXAMPLES

The present invention is illustrated by the following Examples which, however, are not to be construed as limiting the present invention to their details.

EXAMPLE 1

A polyethylene terephthalate (hereinafter "PET") film with 4 micrometer thickness and 100 mm width, had a lubricate heat resistance layer on one side at an interval of 200 mm (i.e. the layer and the portion not having the layer are alternatively present in an interval of 200 mm) and an anchor layer on the other side corresponding to the lubricate heat resistance layer (i.e. the anchor layer is also alternatively present in an interval of 200 mm). The anchor layer was formed by coating on the PET film a paint which contains 3 parts by weight of an unsaturated polyester resin, 0.5 parts by weight of Coronate L (available from Nippon Polyurethane Industry Co., Ltd.), 70 parts by weight of toluene and 70 parts by weight of 2-butanone, followed by drying. The PET film was coated by a wire bar with a paint prepared from the following ingredients on the portions not having the anchor layer to form a printing layer.

| Ingredients | Parts by weight |
|---|---|
| Polyvinyl butyral resin*1 | 4 |
| Fluorine-containing acryl silicon resin*2 | 0.9 |
| D-n-butyltin dilaurate | 0.004 |
| Toluene | 18 |
| 2-Butanone | 18 |

*1Available from Sekisui Chemical Co., Ltd. as BL-S having a polymerization degree of 350.
*2Available from Sanyo Chemical Industries, Ltd. as F-2A having 48 wt % active ingredients.

The coated film was dried and then heated at 100° C. for 30 minutes to form a printing layer having about 2 micrometer thickness, about 100 mm width and about 100 mm length.

The PET film was coated by a wire bar with a paint prepared from the following ingredients on the anchor layers to form a color layer having 1 micrometer thickness, about 100 mm width and about 100 mm length.

| Ingredients | Parts by weight |
|---|---|
| Azo disperse dye | 2.8 |
| Polyvinyl butyral resin*3 | 4 |
| Amide-modified silicone oil | 0.02 |
| Toluene | 25 |
| 2-Butanone | 25 |

*3Available from Sekisui Chemical Co., Ltd. as BH-S.

The resulting sheet was bent so that the color layer was placed on the printing layer, and then sandwiched between a thermal head and a platen roller under a pressure of about 3 Kg. Printing was conducted by the following conditions;

| | |
|---|---|
| Printing rate | 33.3 ms/line |
| Printing pulse width | 2–8 ms |
| Maximum printing energy | 6 J/cm$^2$ |

After printing, the bent sheet was opened and no melt fusion was present between the printing layer and the color. Gradation patterns were printed on the printing layer without heat fusion. Subsequently, a plain paper (wood free paper) was heaped on the printing layer and passed at about 180° C. between a rubber covered metal roller and a metal roller under a pressure of about 5 Kg. The PET substrate sheet was removed to find that the printed printing layer was adhered on the plain paper.

The printed image had a reflective printing density of 1.6 at a pulse width 8 ms and was a high quality image having uniform dots from the lower printing density to the higher printing density.

EXAMPLE 2

The substrate as prepared in Example 1 was employed. The PET film was coated by a wire bar with a paint prepared from the following ingredients on the portions not having the anchor layer to form a printing layer.

| Ingredients | Parts by weight |
|---|---|
| Polyvinyl butyral resin*4 | 4 |
| Siloxane acryl silicon resin*5 | 0.44 |
| D-n-butyltin dilaurate | 0.003 |
| Toluene | 18 |
| 2-Butanone | 18 |

*4Available from Sekisui Chemical Co., Ltd. as BM-S having a polymerization degree of 850.
*5Available from Sanyo Chemical Industries, Ltd. as F-6A having 54 wt % active ingredients.

The coated film was dried and then heated at 100° C. for 30 minutes to form a printing layer having about 2 micrometer thickness, about 100 mm width and about 100 mm length.

The PET film was coated by a wire bar with a paint prepared from the following ingredients on the anchor layers to form a color layer having 1 micrometer thickness, about 100 mm width and about 100 mm length.

| Ingredients | Parts by weight |
|---|---|
| Azo disperse dye | 2.8 |
| Vinyl chloride-vinyl acetate copolymer | 4 |
| Amide-modified silicone oil | 0.02 |
| Fluorine-containing acryl silicon resin (F-2A) | 0.25 |
| D-n-butyltin dilaurate | 0.002 |
| Toluene | 25 |
| 2-Butanone | 25 |

*6Polymerization degree about 420 and glass transition temperature 70° C.

The resulting sheet was bent so that the color layer was placed with the printing layer, and then printed as generally described in Example 1. After printing, the bent sheet was opened and no melt fusion was present between the printing layer and the color. Gradation patterns were printed on the printing layer without heat fusion. Subsequently, a bond paper having rough surface (cotton 100%) was heaped on the printing layer and passed at about 200° C. between a rubber covered metal roller and a metal roller as generally described in Example 1. The printed image had a reflective printing density of 1.55 at a pulse width 8 ms and was a high quality image having uniform dots from the lower printing density to the higher printing density.

EXAMPLE 3

Color ink film as prepared in Example 2 was employed.

Printing and transferring were conducted as generally described in Example 1 with the exception that the receive sheet was changed to an OHP transparent PET film. The substrate sheet was removed to find that the printed printing layer was adhered on the OHP film.

The printed image had a reflective printing density of 0.86 at a pulse width 8 ms and was a high quality image having uniform dots from the lower printing density to the higher printing density.

EXAMPLE 4

The substrate as prepared in Example 1 was employed. The PET film was coated by a wire bar with a silicone releasing agent prepared from the following ingredients on the portions not having the anchor layer to form a silicone releasing layer.

| Ingredients | parts by weight |
|---|---|
| Silicone releasing agent*7 | 10 |
| Toluene | 10 |

*7Available from Toray Dow Corning Silicone Co., Ltd. as PRX 305 Dispersion.

The coated film was dried and then heated at 100° C. for one hour to form a silicone releasing layer having about 2 micrometer thickness, about 100 mm width and about 100 mm length.

The film was coated with paints for a color layer and a printing layer as generally described in Example 1 to form a color ink film.

The resulting sheet was bent so that the color layer was placed on the printing layer, and then printed as generally described in Example 1. After printing, the bent sheet was opened and no melt fusion was present between the printing layer and the color. Gradation patterns were printed on the printing layer without heat fusion. Subsequently, a bond paper having rough surface was placed on the printing layer and conducted as generally described in Example 1. The printed image had a reflective printing density of 1.58 at a pulse width 8 ms and was a high quality image having uniform dots from the lower printing density to the higher printing density.

EXAMPLE 5

The substrate as prepared in Example 1 was employed. The PET film was coated by a wire bar with a polymer material paint prepared from the following ingredients on the portions not having the anchor layer to form a polymer material layer having about 1.5 micrometer thickness, about 100 mm width and about 100 mm length.

| Ingredients | Parts by weight |
|---|---|
| Polyvinyl butyral resin*8 | 5 |
| Toluene | 50 |

-continued

| Ingredients | Parts by weight |
|---|---|
| 2-Butanone | 50 |

*8Available from Sekisui Chemical Co., Ltd. as BX-1.

The film was coated with paints for a color layer and a printing layer as generally described in Example 1 to form a color ink film.

The printing layer was coated on the polymer material layer.

The resulting sheet was bent so that the color layer was placed on the printing layer, and then printed as generally described in Example 1. After printing, the bent sheet was opened and no melt fusion was present between the printing layer and the color. Gradation patterns were printed on the printing layer without heat fusion. Subsequently, a bond paper having rough surface was heaped on the printing layer and conducted as generally described in Example 1. The printed image had a reflective printing density of 1.6 at a pulse width 8 ms and was a high quality image having uniform dots from the lower printing density to the higher printing density.

EXAMPLE 6

The substrate as prepared in Example 1 was employed. On the portion not having the anchor layer of the substrate, the same releasing layer was formed as generally described in Example 4. On the releasing layer, the polymer material layer having about 1.5 micrometer thickness, about 100 mm width and about 100 mm length from the following ingredients was formed.

| Ingredients | Parts by weight |
|---|---|
| Polyvinyl butyral resin*9 | 5 |
| Toluene | 50 |
| 2-Butanone | 50 |

*9Available from Sekisui Chemical Co., Ltd. as BL-S.

On the polymer material layer, a paint prepared from the following ingredients was coated with a wire bar to form a printing layer.

| Ingredients | Parts by weight |
|---|---|
| Polyvinyl butyral resin*4 | 4 |
| Fluorine-containing acryl silicon resin*2 | 0.9 |
| D-n-butyltin dilaurate | 0.004 |
| Toluene | 20 |
| 2-Butanone | 20 |

The coated film was dried and then heated at 100° C. for 30 minutes to form a printing layer having about 1 micrometer thickness.

On the anchor coat layer, the color layer was formed as generally described in Example 1 to form a color ink film having the color layer and the laminate alternatively.

The resulting sheet was bent so that the color layer was heaped with the printing layer, and then printed as generally described in Example 1. After printing, the bent sheet was opened and no melt fusion was present between the printing layer and the color. Gradation patterns were printed on the printing layer without heat fusion. Subsequently, a plain paper was placed on the printing layer and passed at about 200° C. between a rubber covered metal roller and a metal roller as generally described in Example 1. The printed image had a reflective printing density of 1.55 at a pulse width 8 ms and was a high quality image having uniform dots from the lower printing density to the higher printing density.

EXAMPLE 7

The plain paper having a transferred image obtained in Example 1 was passed through a heat pressure roller apparatus (consisting of a silicone rubber (rubber hardness=about 60 degree) covered metal roller and a metal roller) under a pressure of about 150 Kg at 180° C. so that the tranferred image was faced with the silicone rubber. As the result, the printing layer on the paper was pressed into the fibers of the paper and the gloss of the printing layer disappeared, thus no difference between the printing layer and the paper surface being observed. Also, the printed image had good properties and no difference between after and before the heat fixing.

EXAMPLE 8

The bond paper having a transferred image obtained in Example 2 was passed through a heat pressure roller apparatus of Example 7 under a pressure of about 100 Kg at 180° C. so that the tranferred image was faced with the silicone rubber. As the result, the printing layer on the paper was pressed into the fibers of the paper and the gloss of the printing layer disappeared, thus no difference between the printing layer and the paper surface being observed. Also, the printed image had good properties and no difference between after and before the heat fixing.

EXAMPLE 9

The plain paper having a transferred image obtained in Example 6 was passed through a heat pressure roller apparatus of Example 7 under a pressure of about 100 Kg at 200° C. so that the tranferred image was faced with the silicone rubber. As the result, the laminate layer (including the polymer material layer and the printing layer) on the paper was pressed into the fibers of the paper and the gloss of the printing layer disappeared, thus no difference between the printing layer and the paper surface being observed. Also, the printed image had good properties and no difference between after and before the heat fixing.

EXAMPLE 10

A gradation pattern was printed as generally described in Example 1 on the printing layer of the color ink film of Example 1. The obtained color ink film was passed a heat roller as generally described in Example 1 at about 200° C. with a plain paper so that the printing layer was faced with the plain paper to obtain an integrated sheet of the substrate and the plain paper. The portion excepting the printing layer was cut off by a cutter. The printed image on the plain paper was covered with the PET film which was the substrate of the color ink film, but the PET film was thin as 4 micrometer and was not seen as covered. The PET film gave glossy looking and the printed image had good properties having uniform dots from the low printing density to the high printing density.

EXAMPLE 11

A gradation pattern was printed as generally described in Example 1 on the printing layer of the color ink film of Example 6. The obtained color ink film was passed a heat roller as generally described in Example 10 with a plain paper so that the printing layer was faced with the plain paper to obtain an integrated sheet of the substrate and the plain paper. The portion excepting the printing layer was cut off by a cutter. The printed image on the plain paper was covered with the PET film which was the substrate of the color ink film, but the PET film was thin as 4 micrometer and was not seen as covered. The PET film gave glossy looking and the printed image had good properties having uniform dots from the low printing density to the high printing density.

EXAMPLE 12

The substrate as prepared in Example 1 was employed. On the portion not having the heat resistant layer of the same side of the substrate, a paint for a polymer material layer comprising 10 parts by weight of polycarbonate and 90 parts by weight of toluene was coated and dried to form a polymer material layer having about 2 micrometer thickness, about 100 mm width and about 100 mm length. On this polymer material layer, a printing layer was formed as generally described in Example 1, with the exception that a polyvinyl butyral (BL-1 available from Sekisui Chemical Co., Ltd. having an average polymerization degree of about 300) was employed instead of the polyvinyl butyral (BL-S). The film was coated by a wire bar with a paint prepared from the following ingredients on the anchor layers to form a color layer having 1 micrometer thickness, about 100 mm width and about 100 mm length.

| Ingredients | Parts by weight |
|---|---|
| Azo disperse dye | 2.8 |
| Vinyl chloride-acrylic ester copolymer*10 | 4 |
| Siloxane containing acryl silicon resin solution (F-6A) | 0.45 |
| Di-n-butyltin dilaurate | 0.005 |
| Toluene | 25 |
| 2-Butanone | 25 |

*10Available from Sekisui Chemical Co., Ltd., as S-LEC E-C110 having polymerization degree about 380 and glass transition temperature 65° C.

The resulting sheet was spiraled so that the color layer was placed on the printing layer, and then printed as generally described in Example 1, Gradation patterns were printed on the printing layer. Subsequently, a plain paper was placed on the printing layer and passed at about 180° C. through the heat roller as generally described in Example 1. The printed image had a reflective printing density of 1.56 at a pulse width 8 ms and was a high quality image having uniform dots from the lower printing density to the higher printing density.

EXAMPLE 13

The substrate as prepared in Example 1 was employed. On the portion not having the anchor coat layer, a releasing layer was formed as generally described in Example 4. On the releasing layer, a paint prepared from the following ingredients was coated by a wire bar to form a printing layer having 1 micrometer thickness.

| Ingredients | Parts by weight |
|---|---|
| Vinyl chloride-acrylic ester copolymer*10 | 4 |
| Fluorine-containing acryl silicon resin solution (F-2A) | 0.9 |
| Di-n-butyltin dilaurate | 0.004 |
| Toluene | 20 |
| 2-Butanone | 20 |

After coating, it was dried and then heated at 100° C. for 30 minutes to form a printing layer.

Next, on the anchor coat layer, a color layer was formed as generally described in Example 1, with the exception that a polyvinyl butyral (BM-2) was employed instead of the polyvinyl butyral (BH-S).

The resulting sheet was bent so that the color layer was placed on the printing layer, and then printed as generally described in Example 1. Gradation patterns were printed on the printing layer. Subsequently, a plain paper was placed on the printing layer and passed at about 200° C. through the heat roller as generally described in Example 1. The printed image had a reflective printing density of 1.53 at a pulse width 8 ms and was a high quality image having uniform dots from the lower printing density to the higher printing density.

What is claimed is:

1. A thermal transfer printing process for forming an image into a printing layer by heating a color layer containing a sublimable dye with a printing head and then transferring said printing layer onto an image receive sheet by pressure of head, comprising the steps of:

providing said color layer and printing layer respectively on one substrate in a certain interval of distance without putting one upon another to form a color ink film, placing a surface of the color layer on a surface of the printing layer and applying heat to the color layer from a side of the substrate with the printing head to form an image into the printing layer, wherein said printing layer is transferred to said image receive sheet.

2. The process according to claim 1 further comprising the step of providing a releasing layer between the printing layer and the substrate.

3. The process according to claim 1 further comprising the step of providing a polymer material layer between the printing layer and the substrate, and transferring the polymer material layer, together with the printing layer, to the image receive sheet.

4. The process according to claim 1 further comprising the step of providing a releasing layer and a polymer material layer between the printing layer and the substrate, the releasing layer being between the polymer material layer and the substrate, and transferring the polymer material layer, together with the printing layer, to the image receive sheet.

5. The process according to any one of claims 1 to 4 wherein said transferred printing layer, together with the transferred polymer material layer, is fixed on the image received sheet by the further step of applying heat and/or pressure.

6. The process according to claim 5 wherein said heat for transferring the printing layer onto the image receive sheet has a heat source which is also used as the heat source for fixing the printing layer in the image receive sheet.

7. A thermal transfer printing process for forming an image into a printing layer by heating a color layer with a printing head and then transferring said printing layer onto an image receive sheet by pressure or heat, comprising the steps of:

providing said color layer and printing layer respectively on one substrate in a certain interval of distance without putting one upon another to form a color ink film, placing a surface of the color layer on a surface of the printing layer, applying heat to the color layer from a side of the substrate with the printing head to form an image into the printing layer, and then placing a surface of the printing layer on the image receive sheet and applying heat and/or pressure thereto to integrate the image receive sheet and the color ink film.

8. The process according to claim 7 further comprising the step of providing a releasing layer between the printing layer and the substrate.

9. The process according to claim 7 further comprising the step of providing a polymer material layer between the printing layer and the substrate.

10. The process according to claim 7 further comprising the step of providing a releasing layer and a polymer material layer between the printing layer and the substrate, the releasing layer being between the polymer material layer and the substrate.

11. The process according to claim 1 or 7 wherein the substrate has surface properties which are different between teh surface facing the color layer and the surface facing the printing layer.

12. The process according to claim 1 or 7 wherein the color layer contains a binder, and the printing layer or the binder of the color layer is prepared from a resin selected from a group consisting of acrylonitrile-styrene copolymer, polystyrene, styrene-acryl copolymer, polyvinyl chloride resin, chlorinated polyvinyl chloride, polyvinyl acetate, vinyl chloride-vinyl acetate copolymer, vinyl chloride-acrylic ester copolymer, saturated polyester, polyester urethane, cellulose resin, rubber chloride, chlorinated polypropylene, polycarbonate and a mixture thereof.

13. The process according to claim 1 or 7 wherein said color layer contains a binder and a fluorine or siloxane-containing moisture curable resin in addition to the binder.

14. The process according to claim 1 or 7 wherein said printing layer has a flow softening point of 200° C. or less.

15. The process according to claim 1 or 7 wherein said heat is applied by a thermal printing head.

16. The process according to claim 3, 4, 9 or 10 wherein said polymer material layer is formed from a water soluble or water dispersible resin.

17. The process according to claim 3, 4, 9 or 10 wherein said polymer material layer is formed from a polymer material selected from a group consisting of polyvinyl alcohol or a derivative thereof, cellulose derivative, modified starch, starch derivative, chlorinated resin, polycarbonate and a mixture thereof.

18. The process according to claim 3, 4, 9 or 10 wherein said polymer material layer has a flow softening point of 200° C. or less.

* * * * *